United States Patent [19]

Tatebe et al.

[11] Patent Number: 4,959,030

[45] Date of Patent: Sep. 25, 1990

[54] ELECTRICAL CONNECTOR FOR CONNECTING TWO FLAT CABLES TO A CIRCUIT BOARD

[75] Inventors: Yu Tatebe; Hiroshi Yasui; Yukio Matsuyama; Hiroji Takahashi, all of Tokyo, Japan

[73] Assignees: Japan Aviation Electronics Industry, Limited; NEC Corporation, both of Japan

[21] Appl. No.: 488,400

[22] Filed: Feb. 28, 1990

Related U.S. Application Data

[63] Continuation of Ser. No. 233,206, Aug. 17, 1988, abandoned.

[30] Foreign Application Priority Data

| | | | |
|---|---|---|---|
| Aug. 19, 1987 | [JP] | Japan | 62-125116[U] |
| Aug. 19, 1987 | [JP] | Japan | 62-125117[U] |
| Sep. 4, 1987 | [JP] | Japan | 62-134645[U] |

[51] Int. Cl.[5] ..... H01R 9/07; H01R 9/09

[52] U.S. Cl. ..... 439/67; 439/493; 439/498

[58] Field of Search ..... 439/67, 77, 449, 456, 439/459, 492–499, 637

[56] References Cited

U.S. PATENT DOCUMENTS

| | | | |
|---|---|---|---|
| 3,154,365 | 10/1964 | Crimmins | 439/496 |
| 3,634,806 | 1/1972 | Fergusson | 439/494 |
| 3,941,448 | 3/1976 | Evans | 439/493 |
| 3,989,336 | 11/1976 | Rizzio, Jr. et al. | 439/499 |
| 4,519,133 | 5/1985 | Pansanel | 439/495 |
| 4,734,053 | 3/1988 | Imai | 439/494 |
| 4,787,863 | 11/1988 | Horng | 439/695 |

FOREIGN PATENT DOCUMENTS

| | | | |
|---|---|---|---|
| 264072 | 9/1964 | Australia | 439/495 |
| 2149180 | 4/1972 | Fed. Rep. of Germany | 439/496 |
| 2275039 | 1/1976 | France | 439/496 |
| 2536593 | 5/1984 | France | 439/496 |
| 1317264 | 5/1973 | United Kingdom | 439/496 |

*Primary Examiner*—Gary F. Paumen

*Attorney, Agent, or Firm*—Laff, Whitesel, Conte & Saret

[57] ABSTRACT

The invention comprises a compact, reliable, and handy electrical connector for connecting two flat cables to a circuit board, by connecting the electrical circuits on the front side of the circuit board to one flat cable and the electrical circuits on the rear side of the circuit board to another flat cable.

13 Claims, 6 Drawing Sheets

ELECTRICAL CONNECTOR FOR CONNECTING TWO FLAT CABLES TO A CIRCUIT BOARD

This application is a continuation of application Ser. No. 233,206, filed Aug. 17, 1988, now abandoned.

BACKGROUND OF THE INVENTION

This invention relates to an electrical connector for connecting two flat cables to a circuit board.

A circuit board usually has front and rear sides which, respectively, have electrical circuits thereon.

A conventional method which is used to connect such a circuit board to a flat cable or flat cables are;

(1) to use one electrical connector for connecting the electrical circuits on the front and the rear sides of the circuit board to one flat cable, or (2) to use two electrical connectors, one for connecting the electrical circuit on the front side of the circuit board to one flat cable and the other for connecting the electrical circuit on the rear side of the circuit board to another flat cable.

The use of two electrical connectors complicates the connection. On the other hand, to use one electrical connector, for connecting the electrical circuit on the front side of the circuit board to one flat cable and for connecting the electrical circuit on the rear side of the circuit board to another flat cable would be most helpful for equipment designers. However, heretofore such an electrical connector is not available.

SUMMARY OF THE INVENTION

It is, therefore, an object of the invention to provide a compact, reliable, and handy electrical connector for connecting two flat cables to a circuit board, by connecting the electrical circuits on the front side of the circuit board to one flat cable and the electrical circuit on the rear side of the circuit board to another flat cable.

Other object of this invention will become clear as the description proceeds.

According to this invention, there is provided an electrical connector for use in electrical connection of a cable with an object. The electrical connector comprises an insulator housing with a specific outer surface and a contact member held in the insulator housing. The cable has a cable end and a remaining portion extended from the cable end. The contact member is adapted to make an electric contact with the object and comprises a terminal portion for electrically and mechanically connecting with the cable end. The remaining portion has a particular portion outside of the insulator housing. The electrical connector further comprises restriction means for restricting the particular portion in a condition extending along the specific outer surface, and mechanical coupling means for mechanically coupling the restriction means to the insulator housing. The restriction means is opposite the specific outer surface with a single gap between the restriction means and the specific outer surface. The single cap enables the cable to extend therethrough and to extend along the specific outer surface.

BRIEF DESCRIPTION OF THE DRAWING:

FIG. 2*a* is a sectional view of a circuit board;

Figure 1:
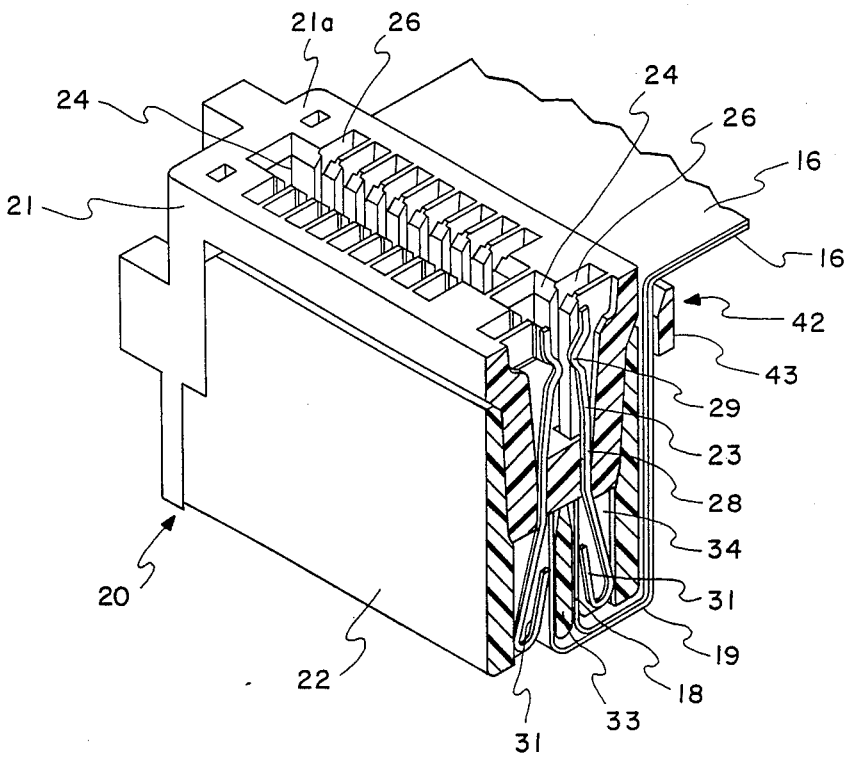
FIG. 1 is a sectional perspective view of an electrical connector according to a first embodiment of this invention.
Figure 2:
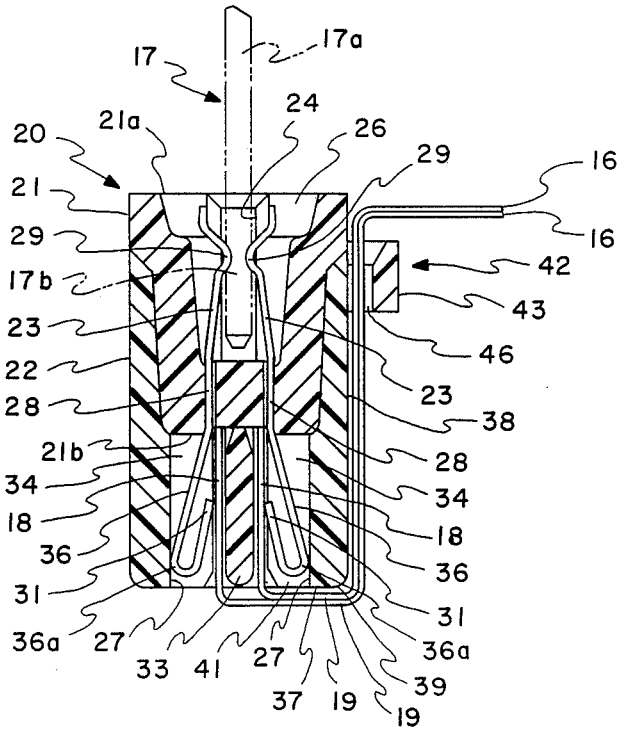
FIG. 2 is a sectional view of the electrical connector shown in FIG. 1.

DESCRIPTION OF THE PREFERRED EMBODIMENTS:

Referring to FIGS. 1 and 2, an electrical connector according to a first embodiment of this invention is for electrically connecting two flat cables 16 with an object. In the example, the object is an electric circuit board 17. Each of the flat cables 16 comprises a plurality of conductive wires arranged in parallel to one another and an insulating layer covering the conductive wires in the manner known in the art. Each of the flat cables 16 has a cable end 18 and a remaining portion 19 extended from the cable end 18. At the cable end 18, the insulating layer is removed or cut away from the conductive wires. In other words, the conductive wires are exposed at the cable end 18.

The electric circuit board 17 comprises a central portion 17*a* and an edge portion 17*b* which is separated into two sections with a gap but is integral with the central portion 17*a*. The central portion 17*a* has an electrical circuit (not shown) thereon in the manner known in the art. As will be shown in FIG. 2*a*, the edge portion 17*b* has a plurality of conductive patterns 171 and 172 which are on the front and rear surfaces thereof and which are electrically connected to the electrical circuit in the manner known in the art.

The electrical connector comprises first and second insulator members 21 and 22 and a plurality of conductive contact members 23. A combination of the first and the second insulator members 21 and 22 will be called an insulator housing as depicted at a reference numeral 20.

The first insulator member 21 has, in a top surface 21*a* thereof, two central grooves 24 linearly extending in a first direction and a plurality of side recesses 26 recessed from side walls of each of the central groove 24 in a second direction which is perpendicular to the first direction. The central grooves 24 are for receiving the two sections of the edge portion 17*b* of the electric circuit board 17 therein, respectively. The side recesses 26 are preassigned to the contact members 23, respectively, as will later be described in detail.

The second insulator member 22 is fitted on the first insulator member 21 and has inner surfaces 27 defining a predetermined space under a bottom surface 21*b* of the first insulator 21.

The contact members 23 are arranged in two rows, each row extending in the first direction. Each of the contact members 23 comprises supporting, contact, and terminal portions 28, 29, and 31 and is disposed so that the contact portions 29 are placed in the central groove 24 adjacent and opposite to the side recesses 26, respectively. In this event, the supporting portions 28 are supported or fixedly mounted to the first insulator member 21. The terminal portions 31 are placed in the predetermined space.

Since the contact members 23 are arranged in two parallel rows as described above, the terminal portions 31 are also arranged in two rows which are apart from each other in the second direction. In other words, the terminal portions 31 are divided into two terminal portion groups corresponding to the two rows, respectively.

When the edge portion 17*b* of the electric circuit board 17 is inserted into the central grooves 24 of the first insulator member 21, the contact portions 29 of the contact members 23 are forced into the side recesses 26, respectively, by the edge portion 17*b*. Moreover, the contact portions 29 are elastically forced to come in contact with the conductive patterns of the edge portion 17*b*, respectively. As a result, the contact members 23 in each row are electrically connected with the electrical circuit on each side of the electric circuit board 17.

The electrical connector further comprises a fastening member 33 made of insulator. The fastening member 33 is inserted between the terminal portion groups. More particularly, the fastening member 33 is placed in the predetermined space to leave two predetermined distances 34 in the second direction between the fastening member 33 and the inner surfaces 27, respectively. As a result, the terminal portion groups are disposed in the predetermined distances 34, respectively. Each of the cable ends 18 is placed between the fastening member 33 and each of the terminal portion groups and is tightly fastened therebetween.

Each of the contact members 23 further comprises a spring portion 36 which is disposed in the corresponding one of the predetermined distances 34. The spring portion 36 is formed in a U-shape having ends which are integral with the supporting and the terminal portions 28 and 31, respectively. The spring portion 36 serves to elastically force the terminal portion 31 towards the fastening member 33. Therefore, each of the cable ends 18 is tightly fastened between the fastening member 33 and each of the terminal portion groups. Thus, the conductive wires are electrically and mechanically coupled to the terminal portions 31 at the cable ends 18, respectively.

In this event, the inner surface 27 of the second insulator member 22 engages with a curved portion 36*a* of each of the spring portions 36 to back up the spring portions 36. Therefore, the inner surface 27 may be referred to as a back up arrangement.

The insulator housing 20 has first and second side surfaces 37 and 38 which are adjacent each other. The first and the second side surfaces 37 and 38 are connected to form a corner 39 and are perpendicular to each other at the corner 39. In order to enable the flat cables 16 to be lead out from the predetermined distances 34, the first side surface 37 has a lead-out opening 41 connected to the predetermined space.

The flat cables 16 are lead out as the remaining portion 19 from the predetermined distances 34 through the lead-out opening 41, respectively. Each of the remaining portions 19 is extended along the first and the second side surfaces 37 and 38. In this event, it is a matter of course that the remaining portion 19 is turned at the corner 39.

The electrical connector further comprises a cable hook member 42 which is rendered integral with the first insulator member 21. The cable hook member 42 comprises a bar portion 43 and two coupling portions 46 which are for coupling both ends of the bar portion 43 to the first insulator member 21, respectively. The bar portion 43 is opposite to a specific outer surface of the second side surface 38 with a predetermined gap left between the second side surface 38 and the bar portion 43. Each of the flat cables 16 has a thickness which is slightly smaller than a half of the predetermined gap.

In addition, the bar portion 43 extends along the second side surface 38 in parallel with the first direction so that the predetermined gap has a width which is slightly more than that of each of the flat cables 16.

The two flat cables 16 are passed through the predetermined gap with a superposed condition and are then turned perpendicular to the second side surface 38 to thereby engage with the bar portion 43. In this event, the flat cables 16 have a particular portion which is restricted or constrained by the bar portion 43 in a condition extending along the specific outer surface of the second side surface 38. Therefore, the bar portion 43 is referred to as a restriction arrangement.

When it is assumed that an external force is applied to pull another end of at least one of the flat cables 16, the external force is transmitted to the cable end 18 through the flat cable 16 and a tensile force generates on the flat cable 16. However, the external force is reduced during transmission through the flat cable 16, because the flat cables 16 are turned and constrained at the bar portion 43. Therefore, it is possible to reduce a tensile force which acts to the cable end 18 due to the external force.

Figure 3:
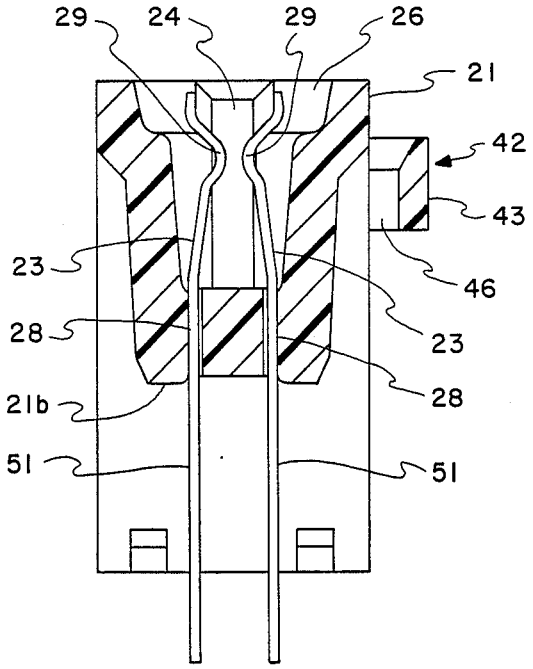
FIGS. 3 to 5 illustrate steps of assembling of the electrical connector shown in FIG. 1.
Figure 4:
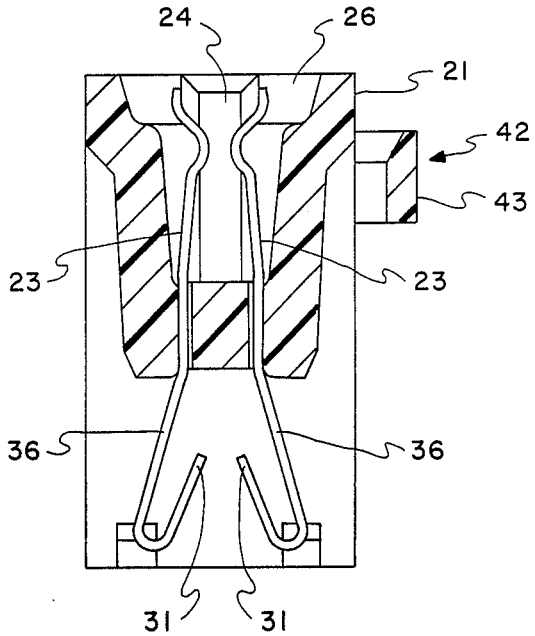

Referring to FIGS. 3 to 7, description will be made as to steps of assembling of the electrical connector. In FIG. 3, the contact members 23 are held in the first insulator member 21. In the state, each of the contact members 23 comprises a straight portion 51 straightly and downwardly extending from the bottom surface 21*b*. As shown in FIG. 4, the straight portion 51 is bent inwardly and upwardly to form the terminal and the spring portions 31 and 36.

Figure 5:
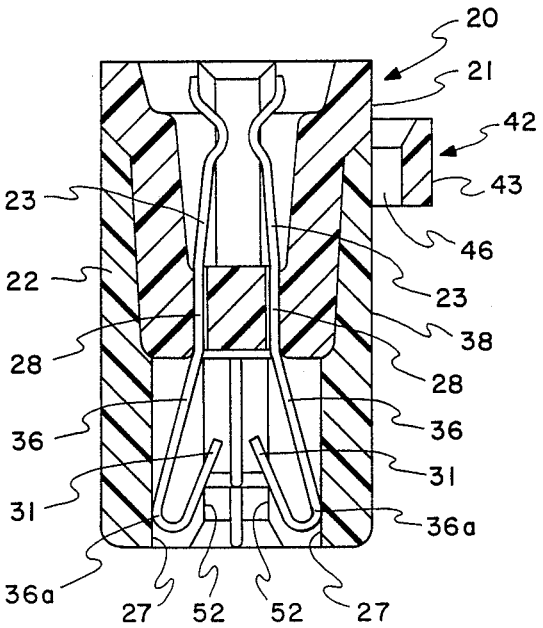

Turning to FIG. 5, the second insulator member 22 is fitted on the first insulator member 21 to make the predetermined space containing the terminal and the spring portions 31 and 36. The second insulator member 22 has a plurality of partitioning walls 52 which are parallel with one another with an additional distance left therebetween for containing the terminal and the spring portions 31 and 36. The partitioning walls 52 serve as an enclosure for protecting the terminal and the spring portions 31 and 36.

Figure 6:
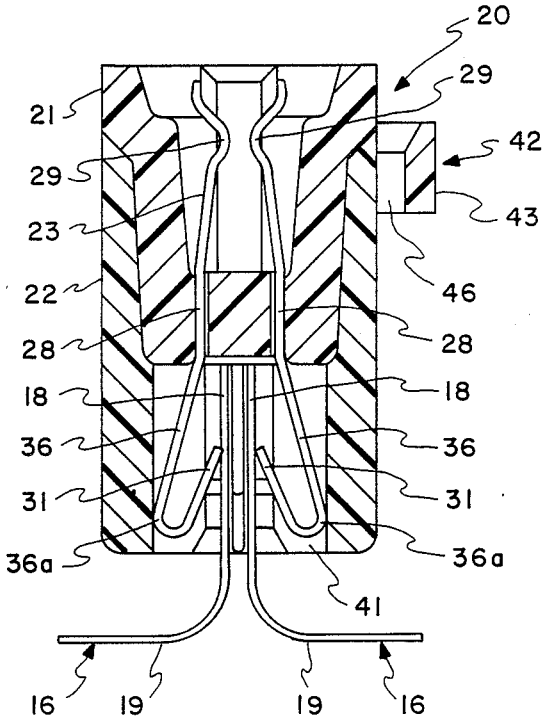
FIGS. 6 and 7 illustrate steps of connecting a cable with the electrical connector shown in FIG. 1.

As shown in FIG. 6, the cable ends 18 of the flat cables 16 are inserted through the lead-out opening 41 into the predetermined space. As a result, the cable ends 18 are placed between the terminal portion groups in the predetermined space. In the condition, the remaining portions 19 of the cables 16 are separated from each other.

Figure 7:
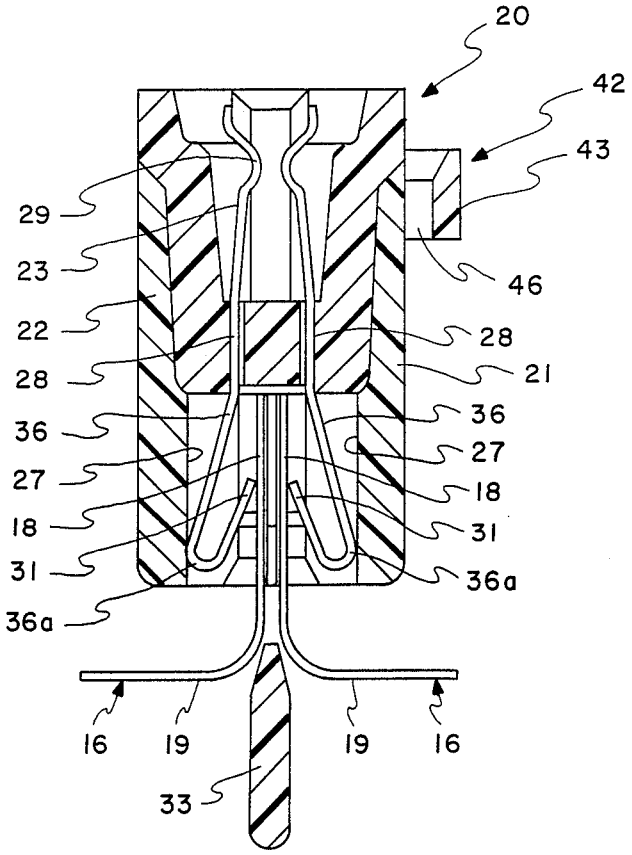

Next, the fastening member 33 is inserted between the cable ends 18 as shown in FIG. 7. As a result, the conductive wires of the cable ends 18 are brought in press contact with the terminal portions 31 of the contact members 23, respectively.

Then, the remaining portions 19 of the flat cables 16 are collectively extended along the first and the second side surfaces 37 and 38 and are passed through the above-mentioned predetermined gap, as shown in FIGS. 1 and 2. As a result, the remaining portions 19 are formed in a crank shape as shown in FIGS. 1 and 2.

Figure 8:
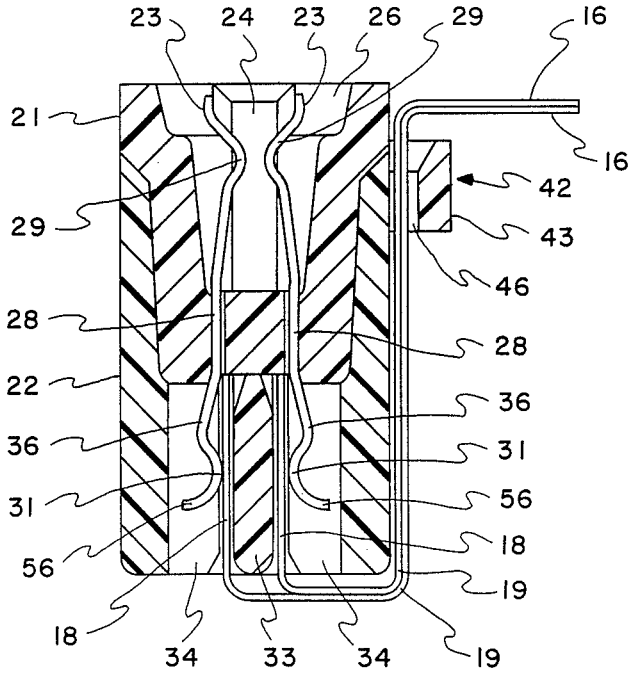
FIG. 8 is a perspective view of an electrical connector according to a second embodiment of this invention.

Referring to FIG. 8, description will be made as regards an electrical connector according to a second embodiment of the present invention. The electrical connector comprises similar parts designated by the same reference numerals as in FIGS. 1–7. In FIG. 8, the spring portion 36 is simpler than that in FIGS. 1 and 2. More particularly, the spring portion 36 is merely formed in an arch shape apart from the cable end 18. Each of the contact members 23 further comprises a guide portion 56 extending from the terminal portion 31 outwardly. The guide portion 56 is for guiding the fastening member 33 to be inserted between the terminal portion groups.

Figure 9:
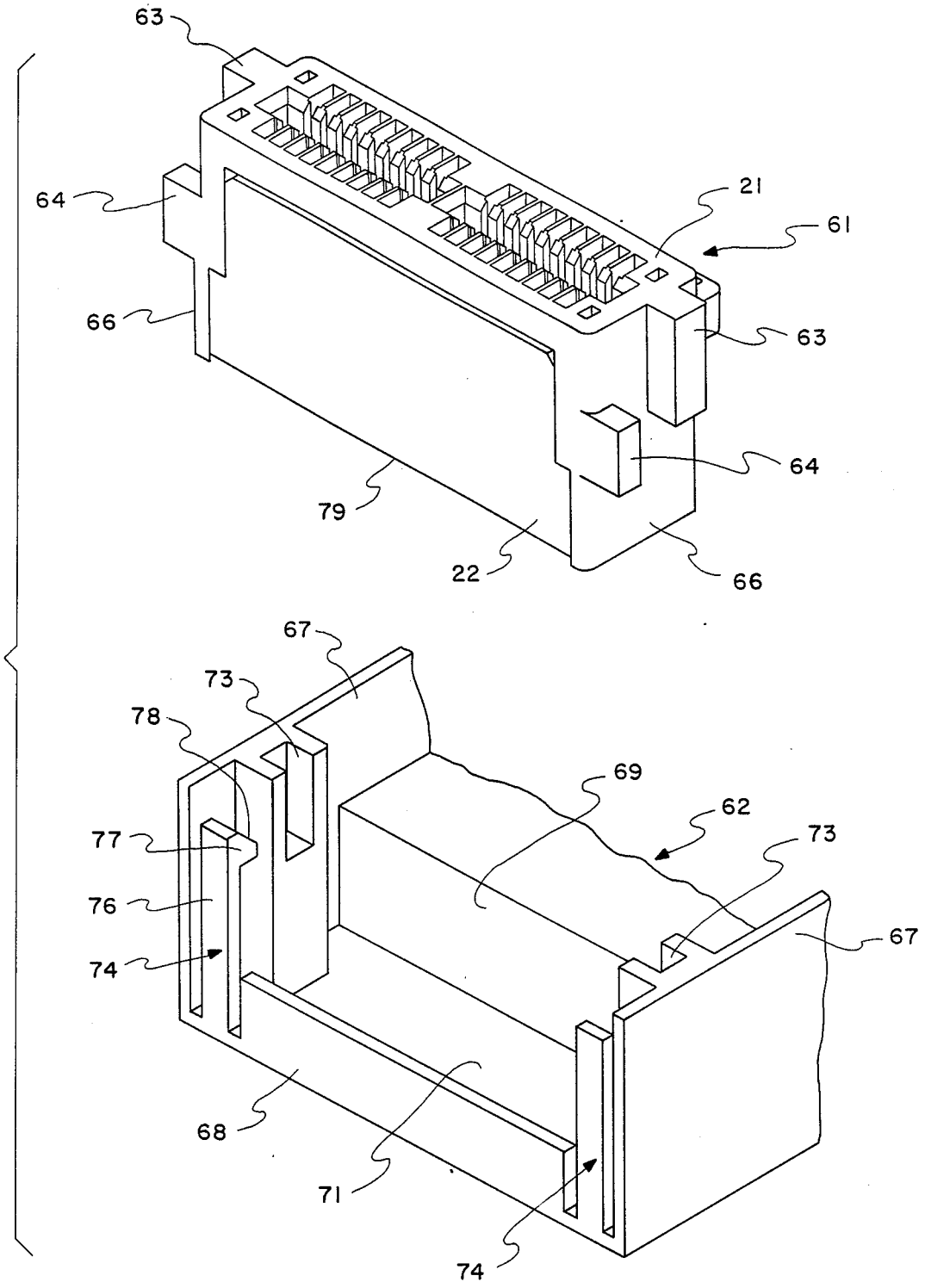
FIG. 9 is a perspective view of a connector holder and the electrical connector shown in FIG. 1.
Figure 10:
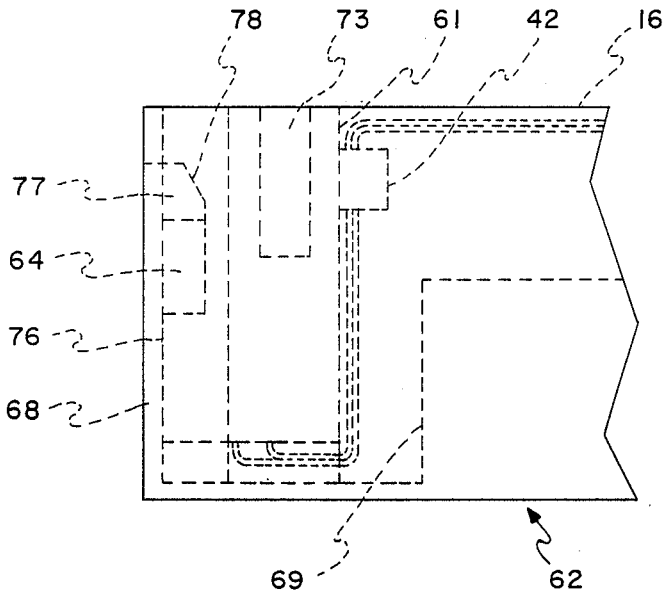
FIG. 10 is a side view of the connector holder, including the electrical connector of FIG. 9.

Referring to FIGS. 9 and 10, description will be made as to the electrical connector 61 and a connector holder 62 which is for mounting the electrical connector 61 on an electrical device, such as an electrical printer. The electrical connector 61 comprises two positioning and two engaging projections 63 and 64. The positioning projections 63 are formed on opposite end surfaces 66 of the first insulator member 21, respectively. Similarly, the engaging projections 64 are formed on the opposite end surfaces 66, respectively. The positioning and the engaging projections 63 and 64 are rendered integral with the first insulator member 21 and are displaced from each other in the second direction.

The connector holder 62 is included in the electrical device and comprises a pair of side walls 67, a front wall 68, a rear wall 69, and a bottom wall 71 collectively defining a receiving chamber which is for receiving the electrical connector 61. When being mounted on the electrical device, the electrical connector 61 is inserted into the receiving chamber.

For positioning the electrical connector 61 in the second direction, the connector holder 62 comprises two positioning grooves 73 made in the side walls 67, respectively. The positioning grooves 73 are for slidably receiving the positioning projections 63 to thereby restrict the electrical connector 61 from moving in the second direction.

The connector holder 62 further comprises two hooking elements 74 placed between the front wall 68 and the side walls 67, respectively. Each of the hooking elements 74 comprises neck and jaw parts 76 and 77. The neck part 76 has a bottom end connected integral with the bottom wall 71 and is elastically deflectable in the second direction. The jaw part 77 is connected integral with another or top end of the neck part 76 and is protruded rearwardly with a slant top surface 78. The jaw part 77 has an original position which slightly projects into the receiving chamber.

When the electrical connector 61 is moved into the receiving chamber of the connector holder 62 downwardly, a bottom corner 79 of the electrical connector 61 engages with the slant top surfaces 78 and pushes the jaw parts 77 frontwardly. As a result, the jaw parts 77 are moved frontwardly with the neck parts 76 elastically deflected. Therefore, the electrical connector 61 is smoothly inserted into the receiving chamber of the connector holder 62.

When the electrical connector 61 is inserted into the receiving chamber, the positioning grooves 73 receive the respective positioning projections 63 therein. In addition, each of the jaw parts 77 returns to the original position thereof due to elasticity of each of the neck parts 76 and resultantly engages a top end of each of the engaging projections 64. Therefore, the electrical connector 61 is reliably held in the receiving chamber.

Each of the flat cables 16 has the other end electrically connected to an electric element, for example, a printer head (not shown) which is mounted to the connector holder 62.

In order to remove the electrical connector 61 from the connector holder 62, each of the hook parts 77 is frontwardly moved at first to deflect each of the neck parts 76. As a result, it becomes possible to move the electrical connector 61 upwardly. Therefore, the electrical connector 61 can readily be removed from the connector holder 62.

While the present invention has thus far been described in connection with only specific embodiments thereof, it will readily be possible for those skilled in the art to put this invention into practice in various other manners. For example, the invention can be embodied in a modified electrical connector which is for electrically connecting a cable with another cable. In this event, the modified electrical connector is made to be capable of coupling with a corresponding mating connector which is connected to the other cable. In addition, soldering may be carried out between the terminal portion and the cable end. The cable hook member may be removable from the insulator housing.

What is claimed is:

1. An electrical connector for connecting first and second flat cables to a circuit board having front side conductors and rear side conductors, each of said first and said second flat cables having a cable end and a remaining portion extended from said cable end, said connector comprising:

an insulator housing with a specific outer surface;

first and second groups of contact members held in said insulator housing and arranged in first and second spaced parallel contact rows, with a space between said first and said second rows for receiving said circuit board therein to make electrical connections between said first and said second contact member groups and said front and said rear side conductors, said contact members of said first and said second groups having terminal portions for electrically and mechanically making connections with said cable ends of said first and said second flat cables, respectively, said remaining portion of each of said first and said second flat cables having a particular portion outside of said insulator housing;

restriction means for restricting said particular portion to extend along said specific outer surface;

mechanical coupling means for coupling said restriction means to said insulator housing, said restriction means being opposite to said specific outer surface with a single gap left between said restriction means and said specific outer surface, said single gap enabling said cable to extend therethrough in order to make said particular portion extend along said specific outer surface; and fastening means made of insulation and coupled to said insulator housing between said first and second terminal portions for tightly pressing said cable ends against said first and said second terminal portions.

2. An electrical connector as claimed in claim 1, wherein said fastening means is removable from said insulator housing.

3. An electrical connector as claimed in claim 1, wherein each of said contact members of said first contact member group further comprises a first spring portion coupled to said first terminal portion for elastically forcing said first terminal portion onto said cable end, each of said contact members of said second contact member group further comprising a second spring portion coupled to said second terminal portion for elastically forcing said second terminal portion onto said cable end.

4. An electrical connector as claimed in claim 3, wherein said insulator housing comprises back up means operatively coupled to each of said first and said second spring portions for backing up each of said first and said second spring portions to reliably force each of said first and said second terminal portions onto said cable end.

5. An electrical connector as claimed in claim 3, wherein said insulator housing comprises a first and second insulator member removably coupled to each other, each of said first and said second contact members being supported in said first insulator member, said second insulator member having said back up means.

6. An electrical connector as claimed in claim 5, wherein said mechanical coupling means is mounted on said first insulator member.

7. An electrical connector as claimed in claim 5, wherein said second insulator member has an inner surface defining a predetermined space, said fastening means being placed in said predetermined space with a predetermined distance left between said inner surface and said fastening means, each of said first and said second terminals portions being disposed within said predetermined distance.

8. An electrical connector as claimed in claim 7, said cable ends being placed between said fastening means and said first and second terminal portions, respectively, wherein each of said first and second spring portions elastically forces each of said first and said second terminal portions towards said fastening means to hold said cable end tightly between each of said first and said second terminal portions and said fastening means.

9. An electrical connector as claimed in claim 7, wherein said second insulator housing has a particular surface portion in said inner surface adjacent to each of said spring portions for functioning as said back up means.

10. An electrical connector as claimed in claim 1, wherein said insulator housing has a first and a second side surface adjacent each other and a lead-out opening in said first side surface for leading out said cable therethrough, said second side surface comprising said specific outer surface.

11. An electrical connector as claimed in claim 10, wherein said first and said second side surfaces are connected to form a corner and to be perpendicular to each other at said corner.

12. A combination of an electrical connector as claimed in claim 1 and a connector holder removably supporting said electrical connector for use in mounting said electrical connector on another electrical device, said electrical connector further comprising a pair of positioning projections projecting from opposite end surfaces of said insulator holder, and another pair of engaging projections projecting from said opposite end surfaces of said insulator housing, said connector housing comprising a front wall, a rear wall, and opposite side walls to thereby define a chamber for receiving said electrical connector, said side walls being provided with grooves in inner surfaces thereof for slidably receiving said positioning projections, respectively, when said electrical connector is disposed in said chamber, said connector holder further comprising a pair of hooking means for engaging said engaging projections, respectively to hold said electrical connector in said chamber.

13. An electrical connector for connecting two flat cables to a circuit board, said connector comprising:

an insulator housing; and contact members held or supported in two parallel rows which are spaced from each other in said insulator housing;

each of said contact members having two ends, one of said ends being adapted to make electrical contact with a conductive pattern on an edge portion of said circuit board and the other of said ends being adapted to make electrical with contact with a conductive wire of one of said flat cables in order to electrically connect the front side of said circuit board to one of said flat cables and the rear side of said circuit board to the other of said flat cables; and wherein said contact members are metal springs which make electrical contact with said circuit board and said flat cables with contact pressure applied by their spring action, said electrical connector further comprising:

a fastening member made of insulating material between said two flat cables to force said flat cables against said contact members; and restriction means on a side of said insulator housing to prevent said flat cables from being pulled away from said contact members;

said insulator housing being composed of first and second insulator members removably coupled to each other, said first insulator housing having two positioning projections and two engaging projections to be engaged into a connector holder.

* * * * *